US006042044A

United States Patent [19]

Görke et al.

[11] Patent Number: 6,042,044

[45] Date of Patent: Mar. 28, 2000

[54] AUTOMATIC WINDING MACHINE HAVING TWO YARN GUIDES ON A PIVOTING ARM, SUCH THAT THE YARN IS TRANSFERRED FROM A FULL BOBBIN TO AN EMPTY BOBBIN ON THE RETURN STROKE OF THE ARM

[75] Inventors: Carsten Görke, Meissner-Germerode; Norbert Hinderer, Meinhard-Schwebda; Dirk Müller, Eschwege, all of Germany

[73] Assignee: Georg Sahm GmbH & Co. K.G., Eschwege, Germany

[21] Appl. No.: 09/153,659

[22] Filed: Sep. 15, 1998

[30] Foreign Application Priority Data

Sep. 30, 1997 [DE] Germany ..... 197 43 278

[51] Int. Cl.[7] ..... B65H 54/22; B65H 65/00; B65H 67/048

[52] U.S. Cl. ..... 242/474.5; 242/475.7

[58] Field of Search ..... 242/474.5, 476.1, 242/476.6, 474.6, 474.7, 475.7

[56] References Cited

U.S. PATENT DOCUMENTS

| | | | |
|---|---|---|---|
| 4,216,920 | 8/1980 | Tambara et al. | 242/474.6 |
| 4,300,728 | 11/1981 | Andre et al. | 242/474.5 |
| 4,491,282 | 1/1985 | Hubner | 242/474.6 |
| 4,641,793 | 2/1987 | Flueli et al. | 242/476.1 |
| 5,016,829 | 5/1991 | Schippers et al. | 242/474.6 |
| 5,029,762 | 7/1991 | Behrens et al. | 242/473.5 |
| 5,431,353 | 7/1995 | Horler | 242/474.6 |
| 5,779,170 | 7/1998 | Siepmann et al. | 242/474.5 |

FOREIGN PATENT DOCUMENTS

| | | |
|---|---|---|
| 29 07 848 C2 | 2/1979 | Germany . |
| 195 08 032 A1 | 3/1995 | Germany . |

*Primary Examiner*—Donald P. Walsh
*Assistant Examiner*—Collin A. Webb
*Attorney, Agent, or Firm*—Thomas, Kayden, Horstemeyer & Risley

[57] ABSTRACT

In a method and machine for winding on a continuously fed yarn to form bobbins alternately onto respective tubes on winding spindles on a revolver member, the yarn is guided via a stationary head yarn guide, a traversing device and a contact roller to a first yarn guide to position the yarn at the catch region of the empty tube. A second yarn guide for the yarn end running onto the full bobbin is mounted on a pivotal arm to pivot into the gap between the bobbin and the empty tube. The first yarn guide is arranged on the pivotal arm. The traversing device, the contact roller, the winding spindle and the yarn guides are on one side of the yarn. After pivotal movement of the pivotal arm into the gap the yarn is guided free from the surface of the empty tube and also comes free from the traversing device. During return movement of the pivotal arm the yarn is applied to the catch region of the empty tube with an increase in the wrapping angle.

10 Claims, 4 Drawing Sheets

AUTOMATIC WINDING MACHINE HAVING TWO YARN GUIDES ON A PIVOTING ARM, SUCH THAT THE YARN IS TRANSFERRED FROM A FULL BOBBIN TO AN EMPTY BOBBIN ON THE RETURN STROKE OF THE ARM

FIELD OF THE INVENTION

The invention concerns a winding machine for winding on a continuously fed yarn to form bobbins, alternately onto a respective tube provided with a catch region, having two driven winding spindles which are mounted on a revolver member, a stationary head yarn guide, a traversing device, a contact roller, a first yarn guide which is movable in the winding spindle direction and which positions the yarn relative to the catch region of the empty tube, and a second yarn guide for the end of the yarn passing onto the full bobbin, the second yarn guide being mounted on a pivotal arm and being mounted so that it can be pivoted about a stationary axis into the gap between a bobbin and an empty tube. Also described is a method of winding on a continuously fed yarn to form bobbins, more specifically alternately onto a respective tube provided with a catch region. This therefore involves a continuously operating winding machine having at least two respectively driven winding spindles, onto the tubes of which the yarn is alternately wound. The yarn is divided in the change position so that the end, which is formed in that way, of the preceding yarn is still wound onto the periphery of the full bobbin or package while the new beginning of the yarn, which is formed in that way, is engaged by a catch or capture region of the empty tube and anchored there and then the operation of winding the yarn onto that new tube takes place. The operation of dividing the yarn can be effected in any desired manner, for example by tearing the yarn apart as a result of an increased tension in the yarn, or by means of a cutting device. The invention is also independent of the nature of the configuration of the catch or capture region on the tubes. The catch region can for example be in the form of one or more incisions or slots which are arranged in a distributed array over the periphery of the tube, or it can also be formed by the arrangement of a hook band strip or the like.

BACKGROUND OF THE INVENTION

A winding machine and a method of the kind described in the opening part of this specification is known from DE 195 08 032 A1. The revolver member is driven in the same direction of rotation as the winding spindles. The traversing device and the winding spindles are provided on one side of the yarn while the contact roller is mounted on the other side of the yarn in order to provide a wrapping angle of >90°. Provided in the region of the traversing device is a first yarn guide which is movable in parallel relationship to the winding spindle direction and which serves in the change position to lift the yarn out of the traversing device on the one hand and to bring it into the catch region of the empty tube, on the other hand. Disposed on a pivotal arm is a second yarn guide which can be pivoted into the gap between the empty tube and the bobbin or package. The second yarn guide has an edge which extends inclinedly with respect to the winding spindle direction, and a catch slot or incision for the yarn, by means of which the yarn, as it leaves it, is deposited in the form of a roll portion or raised portion, on the surface of the full bobbin or package. Advantageously that known winding machine uses only two yarn guides which are driven in the form of separate units and are provided as such at different locations. A disadvantage is that this design configuration increases the structural expenditure for the two yarn guides and the drive means which are required therefor. In addition, the two yarn guides are arranged in such a relative position with respect to each other that, in the change position, the yarn is deflected considerably out of the normal laying triangle and is subjected to very severe stressing. The design configuration and mode of operation of the second yarn guide is admittedly advantageous insofar as the wrapping angle of the yarn in the catch region of the empty tube is increased. However, that suffers from the disadvantage that the yarn tension is additionally increased thereby. For many situations of use it is found to be a nuisance that, after the yarn is lifted out of the traversing device and before the second yarn guide performs its inward pivotal movement, the first yarn guide deposits the yarn on the full bobbin in a first roll portion thereon, to which then a second roll portion is further added when the yarn is caught by the second yarn guide and deposited on the full bobbin. There is also the disadvantage that, in the change position of the winding spindles, the yarn is guided along the surface of the empty tube by the movement of the first yarn guide which takes place in the winding spindle direction, with the yarn being subjected to the effect of a corresponding friction. The yarn is displaced in rubbing contact against the surface of the empty tube into the catch region of the empty tube, by virtue of the relative movement between the first and second yarn guides. As the catch region of the empty tube is disposed outside the traversing stroke movement and the spacing between the two yarn guides perpendicularly to the winding spindle direction is not particularly great, it is necessary for the first yarn guide to be given a relatively long stroke movement outside the traversing stroke motion in order to achieve the required heavily inclined position of the yarn with respect to the catch region. That friction which damages the yarn over a corresponding length is further increased by virtue of the fact that the second yarn guide increases the wrapping angle with which the yarn comes into contact with the surface of the empty tube. If foreign bodies or damage is to be found on the surface of the tube, it is not impossible that the yarn, which is travelling at high speed, is unintentionally severed at that point, thereby causing a disturbance in operation.

There are many winding machines which operate with three yarn guides whereby basically the expenditure in terms of design and drive of those three yarn guides is increased. Such a winding machine is known for example from DE 29 07 848 C2. In this case also the first yarn guide is disposed in the region of the traversing device and serves to lift the yarn out of the traversing device and position it relative to the catch or capture region of the empty tube. The second and third yarn guides are even provided in duplicate and mounted on the revolver member in the respective sectors between the two winding spindles. In this case also the second yarn guide serves to lay the end of the departing yarn on the full bobbin while the third yarn guide co-operates with the first yarn guide, more specifically in such a way that the yarn is positioned between those two yarn guides perpendicularly to the winding spindle direction and thus relative to the catch region of the empty tube. The catch region is formed by a slot or incision on the periphery of the empty tube, being disposed perpendicularly to the winding spindle direction. The winding spindles are driven in opposite relationship to the revolver member. The duplicated, second and third yarn guides are inevitably also entrained with the rotary movement of the revolver member, whereby the yarn is considerably deflected, with an increase in the yarn tension. In the change position, the yarn is stretched between the first and third yarn guides and guided under friction acting thereon along the surface of the empty tube until it comes into the groove or incision where it is caught. The orientation of the yarn, which is effected at a right angle to the winding spindle direction, is admittedly advantageous in regard to anchorage of the yarn in the catch region. On the other hand the catch region must be formed by a groove or incision which extends perpendicularly to the winding spindle direction. It is not possible to form the catch region in another fashion.

SUMMARY OF THE INVENTION

The object of the present invention is to provide a winding machine and a method of the kind described, in which only two yarn guides are used and the yarn is kept substantially free from frictional forces acting thereon.

In accordance with the invention, in a winding machine of the kind described in the opening part of this specification, this is achieved in that the first yarn guide is arranged on the pivotal arm of the second yarn guide and that the traversing device, the contact roller, the winding spindle and the two yarn guides are provided on one side of the yarn in such a mutual relative position that after the pivotal movement of the pivotal arm carrying the yarn guides into the gap the yarn is both guided free from the surface of the empty tube and also comes free from the traversing device while during the return pivotal movement of the pivotal arm, using the head yarn guide and the first yarn guide, the yarn is applied to the catch region of the empty tube, with an increase in the wrapping angle.

The basic idea of the invention is that of managing with only two yarn guides and combining those two yarn guides to provide a simplification in structural and operational terms. In part the functions are also distributed differently and the yarn guides have to perform additional functions. Both yarn guides are arranged on a pivotal arm, the drive of which is used to bring both yarn guides into position. The second yarn guide lifts the yarn out of the traversing device and therefore performs a function which hitherto the first yarn guide has to perform. The pivotal movement of the pivotal arm is used for that purpose. The first yarn guide forms with the stationary head yarn guide which is provided in any case an advantageously prolonged laying triangle in which the increase in tension of the yarn is reduced, by virtue of that movement. What is important in this connection is that the essential elements of the winding machine are arranged on a common side of the yarn, from which also the pivotal arm with the two yarn guides can be pivoted into the gap between the tube and the bobbin. That pivotal movement not only serves to bring the yarn into contact with the second yarn guide but at the same time to tension the yarn which passes by way of the head yarn guide, in such a way that the yarn comes free from the traversing device. That yarn-freeing pivotal movement is continued to such a degree that, even upon the pivotal movement of the empty tube into the change position, the yarn does not come into contact with the surface of that tube. The contact roller is also so arranged that it does not involve any contact with the yarn, in the change operation. That contact is brought about only when the yarn is engaged in the catch or capture region. In that way the first yarn guide can laterally move the yarn which is guided freely between it and the head yarn guide, in the winding spindle direction, without the yarn being subjected to friction against relatively movable surfaces. The yarn is so-to-speak moved into a readiness position in front of and at a spacing relative to the catch region of the empty tube, in which case it adopts an inclined position which is less inclined in comparison with the state of the art, as the distance between the head yarn guide and the first yarn guide is advantageously increased. The first yarn guide is then also used to bring the inclinedly disposed yarn into contact with the catch region of the empty tube. That occurs in the return pivotal movement of the pivotal arm with the two yarn guides carried thereon. During that movement, the second yarn guide does not experience a change in its relative position with respect to the full bobbin or package. By virtue of that pivotal movement, the yarn is applied to the catch region so-to-speak with the formation of a wrapping angle, more specifically with a movement which takes place approximately at a right angle with respect to the winding spindle direction, involving only the increase in tension which is required to divide or sever the yarn.

With the new winding machine, it is possible to implement the bobbin change operation while treating the yarn carefully insofar as frictional forces in respect of the surface of the empty tube and the contact roller are kept away from the yarn, during the change operation. It is only at the last moment that the yarn is subjected to a loading by virtue of the catch operation in the catch region. The catch region in itself can be of any desired configuration so that the winding machine can be used for all kinds of tubes. The design configuration and arrangement of the yarn guides which are combined on the pivotal arm represent a component of a particularly simple structure. As that component is not arranged on the revolver member but is pivotable about a stationary pivot axis, this gives the advantage that the two yarn guides only have to be arranged and driven, as a simple single configuration in respect thereof. In spite of the essential components of the winding machine being arranged on one side of the yarn, it is possible for the yarn and the surface of the tube for catching the yarn to be driven in opposite relationship. The revolver member and the winding spindles are preferably also driven in opposite relationship, but they can also be driven in the same direction.

The second yarn guide may have a straight guide edge extending in the winding spindle direction, and a projection which adjoins the guide edge and which extends in the direction of the inward pivotal movement. The straight guide edge which extends substantially over the laying stroke movement provides that the yarn is reliably passed into the gap within a traversing motion in the inward pivotal movement of the pivotal arm, and is pivoted away from the periphery of the empty tube, or the straight guide edge prevents the yarn coming into any contact at all with the surface of the inwardly pivoting empty tube. This occurs also and in particular when bobbins of relatively large diameter are being wound and the winding spindles are driven in opposite relationship to the direction of rotation of the revolver member. On the other hand the straight guide edge of the second yarn guide does not impede the work of the laying device, that is to say as long as the yarn is still in the traversing yarn guide of the traversing device, a laying operation still takes place over the full bobbin at that time. The projection which extends in the direction of the inward pivotal movement is admittedly arranged in the region of the laying stroke movement and in that respect preferably at the edge. It serves for winding the end of the yarn on the full bobbin or package in the form of a raised or roll portion which is placed in the edge region.

The first yarn guide can be mounted on the pivotal arm displaceably in the winding spindle direction in the region of the second yarn guide and may have a hook which is curved in the direction of the return pivotal movement. The first yarn guide is so arranged relative to the second yarn guide that it is operative on the yarn upstream thereof and presses the yarn against the projection which extends in the direction of the inward pivotal movement. In the end position however the first yarn guide reaches a position in which the yarn is held tensioned freely between it and the stationary head yarn guide without being adversely affected by any other friction. As a result of the relatively large spacing between the head yarn guide and the first yarn guide the yarn is in a slightly inclined position, more specifically relative to and at a spacing with respect to the catch region of the empty tube. In a second movement of the first yarn guide in the return pivotal movement of the pivotal arm the first yarn guide entrains the yarn rearwardly, coming into contact with the catch region of the empty tube for the first time. The tension of the yarn is increased with the formation of a wrapping angle in the catch region. That serves to divide or sever the yarn, either in a tearing operation when dealing with relatively thin yarns or in a cutting operation when dealing with thicker yarns.

Advantageously, the winding spindles are driven with their surface in opposite relationship to the direction of travel of the yarn. The yarn is therefore caught in opposite motional relationship, that is to say with the involvement of a relatively high relative speed as between the yarn and the catch region. On the other hand such an opposite motional relationship would represent a particularly high level of frictional loading for the yarn if the yarn were to be pushed in a condition of contact along the surface of the empty tube, as is the case in the state of the art.

The head yarn guide, the traversing device and the contact roller can be arranged in approximately vertical orientation above the axis of rotation of the revolver member. This means that the yarn which is guided between the head yarn guide and the two yarn guides represents so-to-speak a spaced tangent with respect to the surfaces of the traversing device, the contact roller and the empty tube. In this respect also a sufficiently large wrapping angle in respect of the contact roller is achieved during the normal winding procedure.

In additional a yarn holder can be movably mounted in the region of the traversing device on the other side of the yarn, which in a holding position secures the yarn guided by the traversing device and which in a parking position releases the yarn. That yarn holder is not absolutely necessary but on the other hand it is useful if release of the yarn from the traversing device is to be delayed relative to the pivotal movement of the pivotal arm with the two yarn guides or is to be precisely established in respect of time. That can be desirable if application of the yarn with a reduced traversing stroke movement to the full bobbin is also to be continued for a certain period of time after the two yarn guides have pivoted into the gap. Therefore, release of the yarn from the traversing device can be established at a time relative to the movement of the first yarn guide in the winding spindle direction. It will be appreciated that the yarn does not involve any contact with respect to the surface of the empty tube during that reduced traversing motion.

The first yarn guide can be arranged on the pivotal arm displaceably between a parking position provided on the side remote from the catch region of the tube, outside the traversing stroke movement, and a readiness position provided on the side towards the catch region of the tube, outside the traversing stroke movement. The movement of the first yarn guide is therefore only a little greater than the traversing stroke movement. The readiness position is also not far away from the bobbin end as the spacing between the first yarn guide and the stationary head yarn guide can be selected to be relatively great and the stretched yarn therefore only adopts a relatively slightly inclined position with respect to the catch region in the readiness position. That slightly inclined position is advantageous when the catch region is in the form of a groove or incision or a plurality thereof on the periphery of the tube. If the catch region is in the form for example of a hook strip of a loop-and-hook fastener, the readiness position and the movement of the yarn which subsequently occurs at a right angle to the winding spindle direction ensures that the yarn also comes into the middle region of the hook strip and is not deflected away by the edge region of the hook strip.

According to the invention the method of the kind described in the opening part of this specification is characterised in that in the change position the yarn is firstly brought into a readiness position in front of the catch region of the empty tube with the first yarn guide without contact with respect to the empty tube by a movement in the winding spindle direction and is only then brought into contact with the catch region of the empty tube by a movement which occurs perpendicularly to the winding spindle direction. That provides that the yarn is treated with the optimum degree of care, insofar as the moving yarn only runs against the head yarn guide and the two yarn guides while it is kept free from being influenced by frictional forces due to the surface of the empty tube and the contact roller as well as the traversing yarn guide of the traversing device.

The slightly inclined position of the yarn in the readiness position and in the application position ensure for example in conjunction with a hook strip that the entire periphery of the catch region is used for catching or capturing the yarn upon multiple use of the tube. The procedure prevents the formation of an accumulation of torn-away yarn portions in the region of a groove or incision, and the empty tube can be used an increased number of times over a longer period.

During the movement for applying it to the catch region of the empty tube the yarn is guided in a laying triangle which is formed by the head yarn guide and the first yarn guide. The head yarn guide which is provided in any case is used for applying the yarn to the catch region and thus performs an additional function without the level of structural expenditure involved being increased. In terms of the method, a particularly large laying triangle is formed, which is used only in the side region during the laying movement, wherein the geometrical configuration and the way in which the laying movement is implemented from the readiness position into a catch position provides that there is only a moderate increase in the yarn tension. The method is accordingly particularly suitable for winding material which is sensitive to tension therein.

It is particularly advantageous if the yarn is caught in opposite motional relationship in the catch region of the empty tube. With that opposite motional relationship, the catch position is reached particularly quickly so that the operation of dividing or severing the yarn is subsequently implemented in an expedited fashion and the catch region is thus capable of entraining the yarn in accordance with the direction of rotation of the winding spindle of the empty tube and also applying it to the contact roller or guiding it around same. In this respect also a yarn reserve which turns out to be sufficiently long or large is formed between the catch region and the end of the laying stroke movement on the empty tube, as, by virtue of its being guided at the head yarn guide, the yarn only moves back in a slightly inclined position relative to the empty tube and thus slowly passes into the region of the continuously driven traversing device.

The yarn is taken over there and the normal winding-on procedure is then implemented, with the intended traversing stroke movement.

BRIEF DESCRIPTION OF THE DRAWINGS

The invention is described and illustrated in greater detail by means of a preferred embodiment hereinafter. In the drawings.

DETAILED DESCRIPTION

Figure 1:
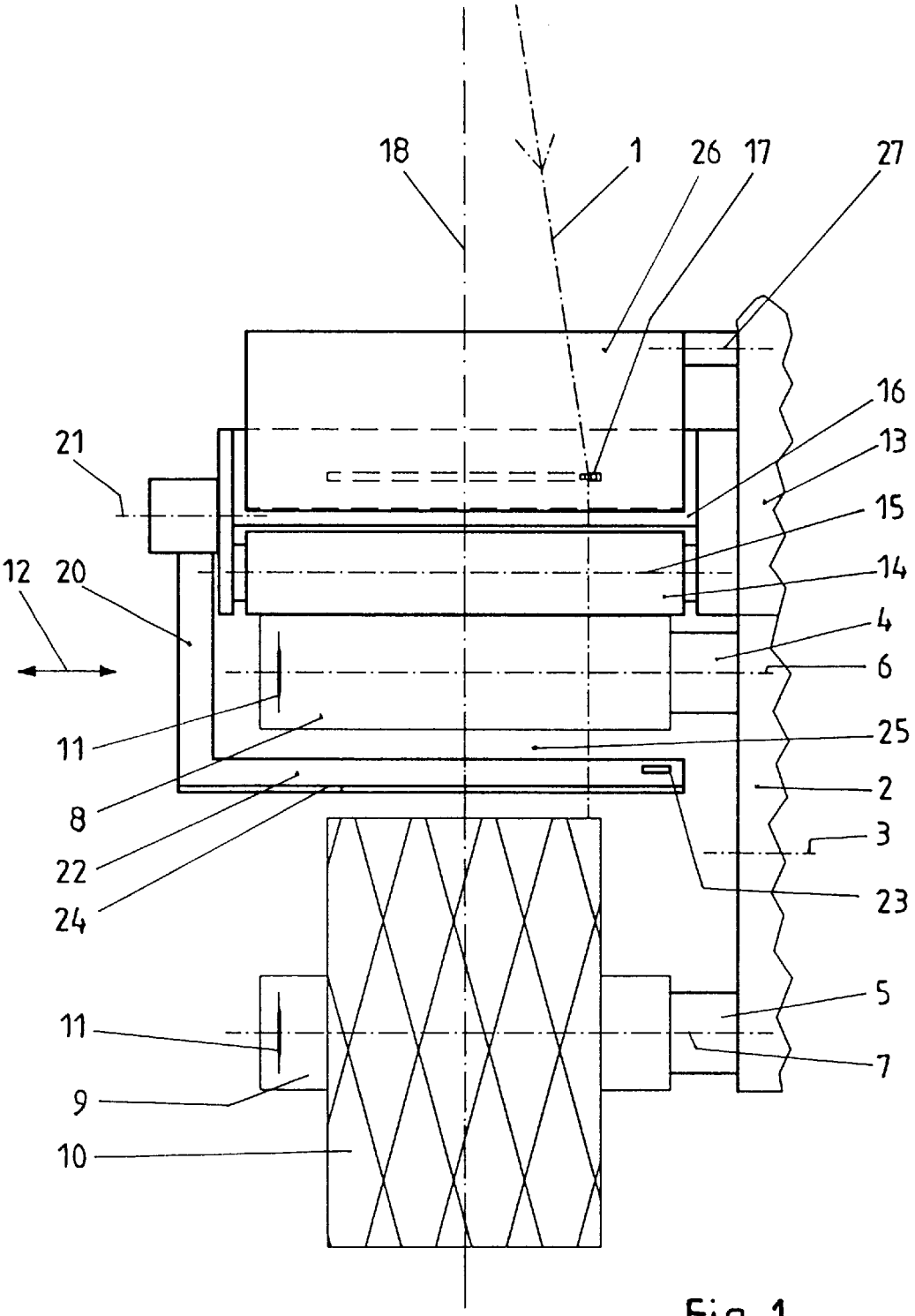
FIG. 1 shows a diagrammatic side view of essential elements of the winding machine.

Referring to FIG. 1, shown therein in dash-dotted line is a yarn 1 which is continuously produced for example in a spinning installation and fed to the winding machine. Without involving losses the yarn 1 is to be taken off, divided up and wound onto tubes to form bobbins or packages. The winding machine has a frame (not shown) on which a revolver member 2 which is for example in the form of a vertically oriented disc is step-wise rotatable about an axis of rotation 3 and can be stopped thereon. At least two winding spindles 4 and 5 are arranged on the revolver member 2 at an equal radial spacing relative to the axis of rotation 3. The winding spindle 4 is driven in rotation about its axis 6 and for that purpose has its own drive (not shown). The winding spindle 5 is driven in rotation about its axis 7 and for that purpose has its own drive (not shown). An empty tube 8 is carried on the winding spindle 4. An (originally) empty tube 9 is also carried on the winding spindle 5, but now the yarn 1 has been wound thereon to form an almost full bobbin or package 10. The winding spindles 4 and 5 are illustrated in the change position in which they are disposed in approximately vertically superposed relationship. Each tube has a catch or capture region 11 which is here in the form of a groove or incision which extends over a part of the periphery of the respective tube 8 and 9. The winding spindles 4, 5 with their tubes 8 and 9 extend in the respective axial direction so that this also establishes a winding spindle direction 12 represented by a double-headed arrow 12, in parallel relationship with the axes 3, 6, 7. The winding spindle direction 12 is perpendicular to the face of the revolver member 2.

Figure 2:
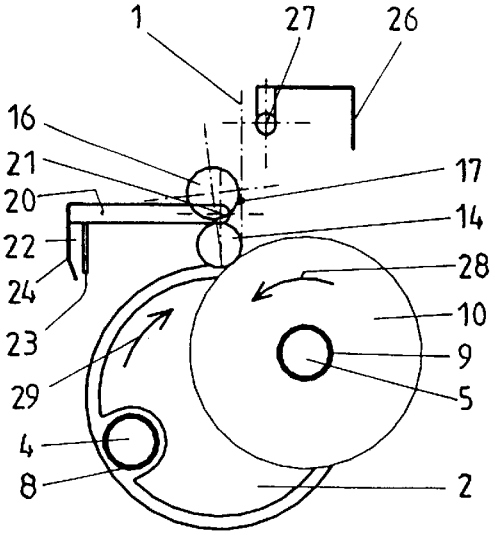
FIG. 2 shows a diagrammatic end view of essential elements of the winding machine during the operation of winding on the yarn to form an almost full bobbin or package.

A contact roller 14 is mounted rotatably about an axis of rotation 15 on the machine frame 13 above the revolver member 2. The surface of the contact roller 14 comes into contact with the surface of the bobbin 10 which is being formed on the respective winding spindle 4 or 5 respectively and is driven by friction at the varying peripheral speed of the bobbin 10. Provided above the contact roller 14 is a traversing device 16 having a traversing yarn guide 17 which is reciprocally driven in accordance with the intended laying stroke movement symmetrically with respect to a vertical central plane 18 so that the yarn 1 is wound or laid on the tube in question to form the bobbin 10. A head yarn guide 19 (FIG. 6) is stationarily arranged in the central plane 18 at some distance above the traversing device 16. A pivotal arm 20 is mounted on the machine frame 13 pivotably about a stationary axis 21. The pivotal arm 20 has a cantilever arm portion 22 on which there are provided a first yarn guide 23 and a second yarn guide 24. The pivotal arm 20 can be pivoted with its cantilever arm portion 22 and the two yarn guides 23 and 24 into the gap 25 which is formed between the surface of an empty tube 8 and the surface of a bobbin 10 in respect of which the winding operation has almost been concluded, in the change position shown in FIG. 1. On the other hand the pivotal arm 20 with its cantilever arm portion 22 and the two yarn guides 23 and 24 can be pivoted back into a parking or rest position which is shown in FIG. 2. The first yarn guide 23 is shown in FIG. 1 in a parking position outside the laying stroke movement, on the side remote from the catch region 11 of the tube 8. The first yarn guide 23 can be moved in the winding spindle direction over the laying stroke movement of the yarn 1 and therebeyond, as can be seen from FIG. 6. For that purpose the first yarn guide 23 has a suitable drive (not shown) operative in the winding spindle direction. The second yarn guide 24 is arranged stationarily with respect to the cantilever arm portion 22 of the pivotal arm 20 and extends substantially over the laying stroke movement.

Figure 3:
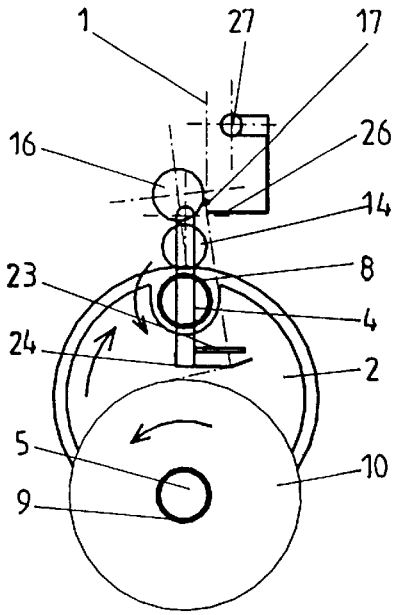
FIG. 3 shows the elements of FIG. 2 in the change position.

A yarn holder 26 is arranged on the machine frame 13 pivotably about an axis 27, above the traversing device 16. A rest position of the yarn holder 26 is shown in FIG. 2. FIG. 3 shows a securing position of the yarn holder 26. As the yarn holder 26 represents a component which is admittedly useful but not absolutely necessary, it should be expressly pointed out here that the yarn holder 26 can also be entirely omitted. Moreover the yarn holder 26 does not necessarily have to be arranged pivotably. It could also be arranged and driven in a guide in a straight line or inclinedly relative to the winding spindle direction 12, in which respect the only important consideration is that in the securing position the yarn holder 26 prevents the yarn 1 from coming free from the traversing device 16, that is to say it secures the yarn 1 thereto while conversely in the starting position it releases the yarn 1.

Figure 4:
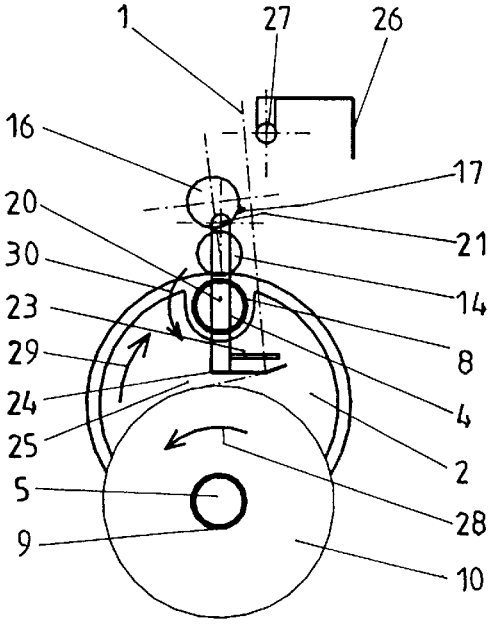
FIG. 4 shows a further intermediate position after the yarn comes free from the traversing device.
Figure 6:
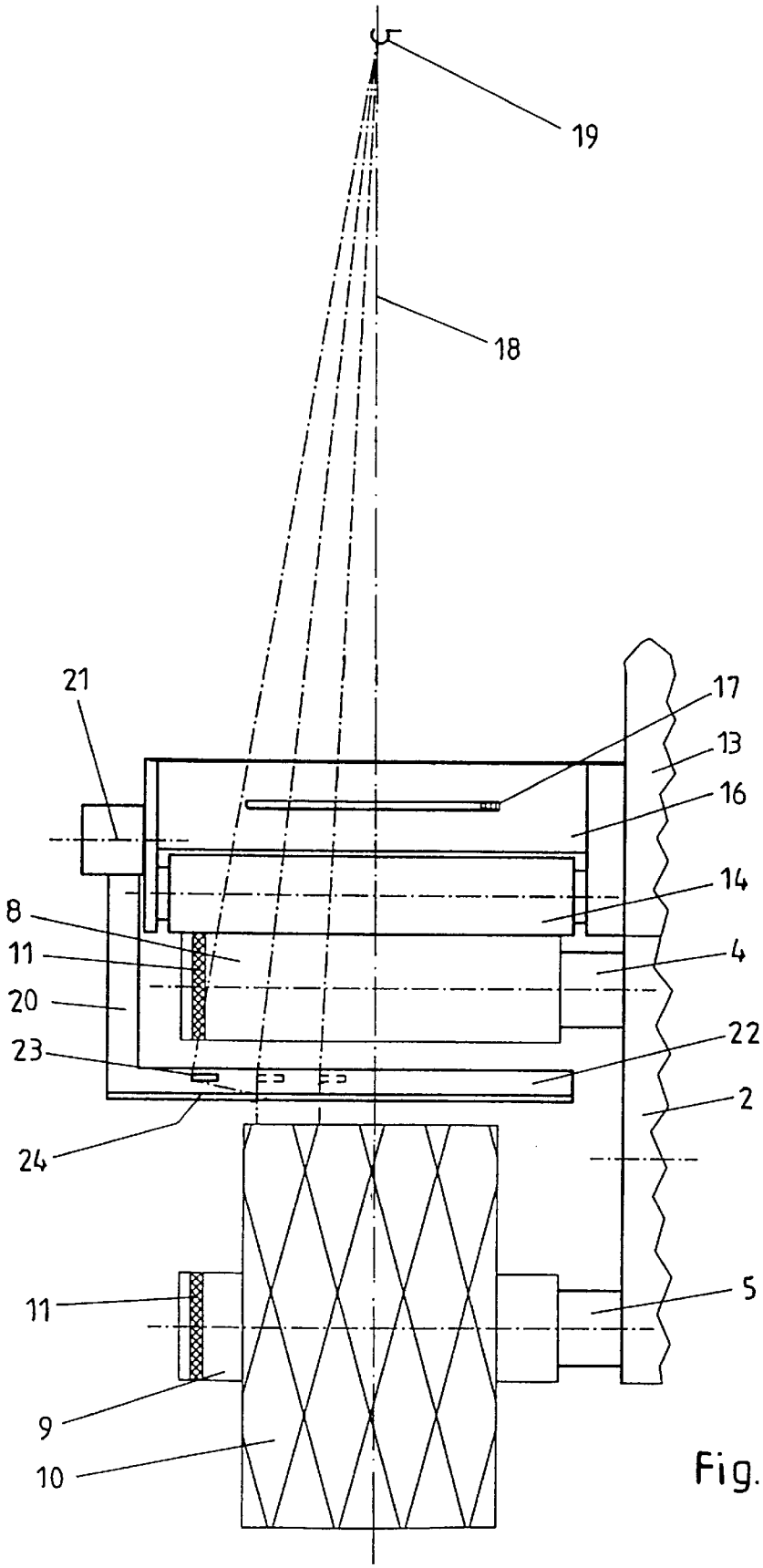
FIG. 6 shows a side view similar to FIG. 1 but involving the action of the first yarn guide.

As shown in FIGS. 1, 2 and 6 the yarn 1 passes by way of the head yarn guide 19 (FIG. 6) to the traversing yarn guide 17 (FIG. 1) and is wound thereby on the tube 9 on the winding spindle 5 to form the bobbin or package 10 (FIG. 2). The winding spindle 5 is driven in the direction of the arrow 28. The yarn 1 passes around the contact roller 14 through a wrapping angle. As the contact roller 14 is stationarily mounted rotatably the revolver member 2 is further rotated as indicated by the arrow 29 with the increasing diameter of the bobbin 10 (FIG. 2). An empty tube 8 is pushed onto the winding spindle 4. As soon as the intended diameter of the bobbin 10 is reached, the revolver member is rotated out of the normal winding position shown in FIG. 2 into the change position as shown in FIG. 4, with a movement as indicated by the arrow 29, the winding spindle being caused to rotate in synchronism therewith in the direction of the arrow 30. The directions of rotation of the two winding spindles 4 and 5 are the same. As soon as the winding spindle 4 is in the upper region of the revolver member 2 and the gap 25 between the surface of the tube 8 and the surface of the full bobbin 10 is accessible for an inward pivotal movement of the pivotal arm 20, the pivotal arm 20 with its cantilever arm portion 22 is pivoted about the axis 21 into the gap 22, as is shown in FIG. 4. When that happens the yarn 1 is prevented by the second yarn guide 24 from making contact with the surface of the empty tube 8 and it also comes free from the surface of the contact roller 14 and also out of the traversing yarn guide 17 of the traversing device 16, as FIG. 4 shows. The yarn 1 is thus guided in a taut condition in that region between the head yarn guide 19 and the second yarn guide 24 without contact with other elements and is still wound onto the full bobbin 10. As soon as the yarn 1 comes free from the traversing device 16 laying of the yarn on the full bobbin 10 is terminated and the yarn runs back towards the central plane. Synchronously therewith the first yarn guide 23 is set in motion out of the rest position shown in FIG. 1 in the winding spindle direction 12, coming into contact with the yarn 1 and moving it along the yarn guide 24, as is illustrated in the various positions in FIG. 6. Finally at the end of the stroke movement of the first yarn guide 23 which is shown in solid line in FIG. 6 the yarn 1 comes into a readiness position in front of and at a spacing with respect to the catch region 11 on the empty tube 8. As the head yarn guide 19 is disposed at a relatively great distance from the first yarn guide 23 the yarn 1 adopts only a relatively slightly inclined position relative to the catch region 11 on the periphery of the tube 8. The catch region 11 is illustrated here in the form of a portion, which is applied over the periphery of the tube 8, of a hook strip of a loop-and-hook fastener.

Figure 7:
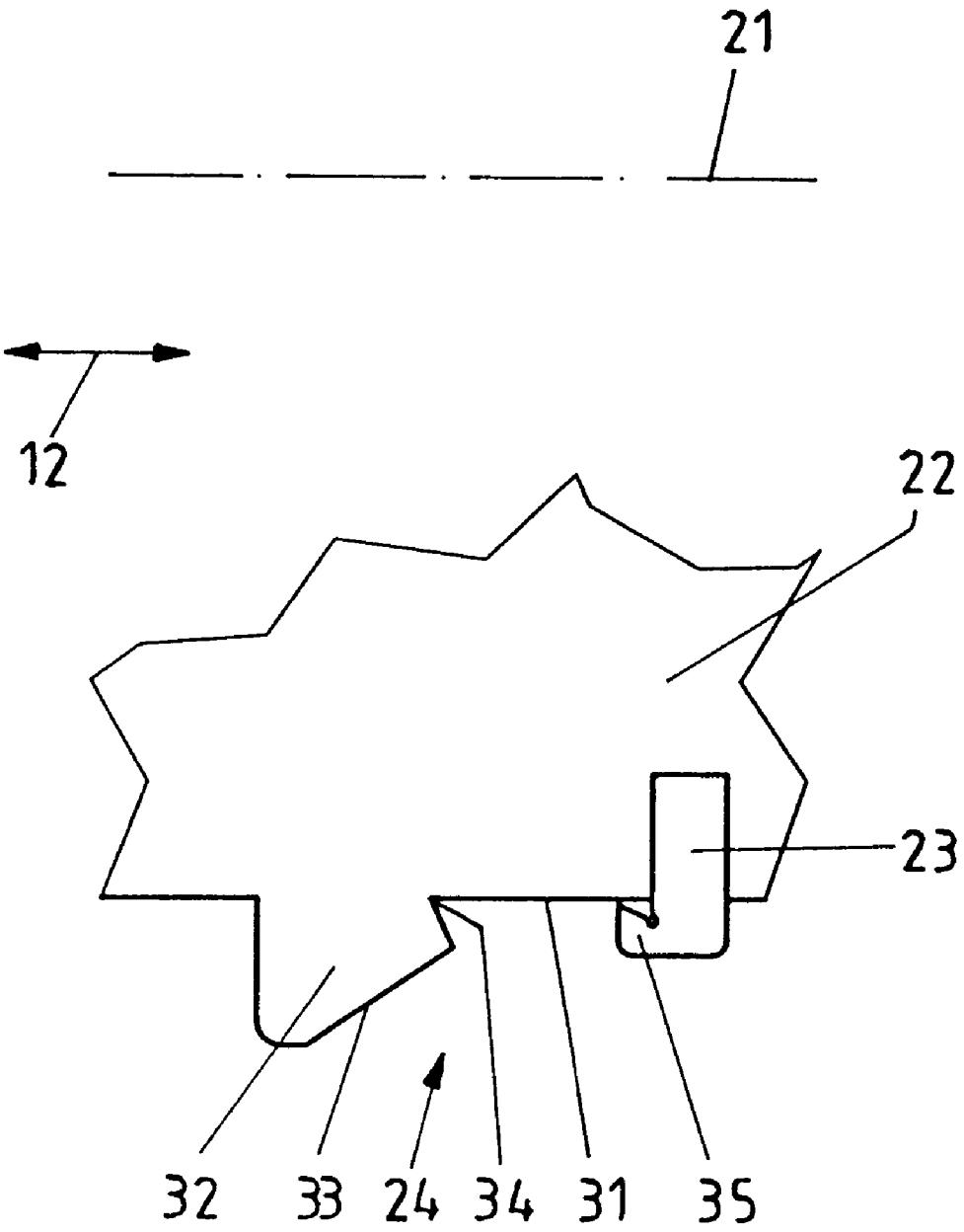
FIG. 7 is a detail view of a portion from the first and second yarn guides.

On the other hand the cantilever arm portion 22 with the two yarn guides 23 and 24 involves a configuration and relative arrangement as can be seen from FIG. 7. The second yarn guide 24 includes a straight guide edge 31 extending in the winding spindle direction 12, and a projection 32. While the guide edge 31 extends from the end of the laying stroke movement, that is towards the machine frame 13 or the revolver member 2, in the winding spindle direction 12, towards the side of the pivotal arm 20, substantially over the major part of the laying stroke movement, the projection 32 is arranged relative to the end of the laying stroke movement which is towards the pivotal arm 20. The projection 32 can be arranged in respect of its largest part and preferably with a repulsion surface 33 in the edge region of the laying stroke movement. The second yarn guide has a notch 34 between the guide edge 31 and the repulsion surface 33. The projection 32 extends in the direction of inward pivotal movement of the pivotal arm 20 or the cantilever arm portion 22 into the gap 25. The first yarn guide 23 extends in the region of the guide edge 31 of the second yarn guide in the direction of pivotal movement into the gap 25 beyond the guide edge 31, as is required by the path of the yarn 1 between the head yarn guide and the guide edge 31 of the second yarn guide 24. The first yarn guide 23 has a hook 35 which is curved rearwardly, that is to say in the direction of return pivotal movement of the cantilever arm portion 22 or the pivotal arm 20, as can be seen from FIG. 7. When the cantilever arm portion 22 pivots into the gap 25, as shown in FIG. 4, the yarn 1 either comes directly into contact with the guide edge 31 or exceptionally into contact with the repulsion surface 33 so that it is guided by same onto the guide edge 31. Then the first yarn guide 23 is set in movement out of its rest position as shown in FIG. 1 in the winding spindle direction 12, that is to say in a direction towards the projection 32, so that it comes into contact with the yarn, more specifically between the head yarn guide 19 and the guide edge 31. When that happens, the first yarn guide 23 lays the yarn on the full bobbin 10 until the first yarn guide 23 passes over the notch 34 on the second yarn guide 24. The yarn 1 which continues to run off the second yarn guide 24 and passes onto the full bobbin 10 is then deposited or wound on the bobbin 10 in the form of a roll portion or raised portion near the edge, by the notch 34. On the other hand, with continuing movement of the first yarn guide 23 the yarn passes into the readiness position shown in FIG. 6 in front of and at a spacing with respect to the catch region 11.

Figure 5:
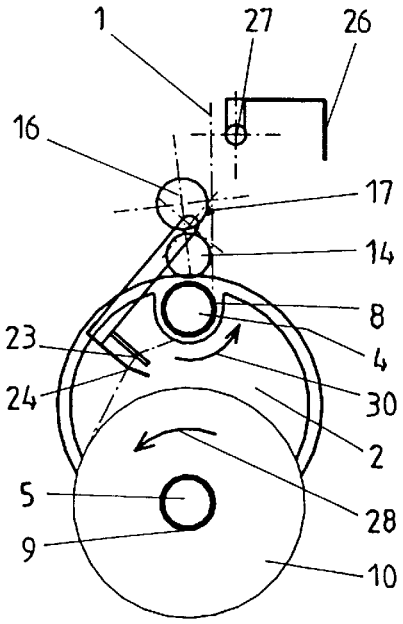
FIG. 5 shows a further position of the elements during the return pivotal movement of the pivotal arm.

The procedure then involves initiation of the return pivotal movement of the pivotal arm 20 with the cantilever arm portion 22, an intermediate position of such movement being shown in FIG. 5. The yarn is fixed between the curved hook 35 of the first yarn guide 23 and the notch 34 of the second yarn guide 24 and during the return pivotal movement is applied to the catch region 11 of the empty tube 8, the yarn 1 moving perpendicularly to the winding spindle direction 12. As soon as the yarn 1 comes into contact with the catch region 11, it is there caught and fixed, while during that movement the wrapping angle around the empty tube 8 is increased. As soon as the catch region 11 has captured the yarn 1, it is entrained by the catch region 11 and the driven winding spindle 4 in the direction of the arrow 30 (FIG. 5) and is suddenly subjected to increased tension so that the yarn 1 tears through in the region of the yarn guides 23 and 24, is severed at a cutting blade edge arranged approximately in the region of the notch 34, or is deliberately cut by a cutting device arranged in that region. With the yarn being entrained by the catch region 11 of the empty tube 8, the yarn also comes into contact with the contact roller 14, and the intended wrapping angle is formed. As, at that time, the yarn is still free from the traversing device 16 which is continuously driven, the yarn slowly moves in a direction towards the central plane 18 by virtue of the yarn tension between the catch region 11 of the empty tube 8 and the head yarn guide 19, with a yarn reserve being formed outside the laying stroke movement on the empty tube 8. The yarn is now inevitably engaged by the traversing yarn guide 17 of the traversing device 16 with the continued return movement towards the central plane 18, so that then the yarn is laid by the laying device 16 in accordance with the normal intended laying stroke movement and a bobbin or package is now formed on the tube 8. The winding spindle 5 is stopped, the full bobbin 10 is removed and a further empty tube is fitted onto the winding spindle 5 so that the procedure for forming the bobbin and the bobbin change operation can then be repeated. It will be appreciated that, after the return pivotal movement of the cantilever arm portion 22 and the pivotal arm 20 into the starting position as shown in FIG. 2, the first yarn guide 23 is also moved back into the starting position.

It is important to recognise that the traversing device 16 with the traversing yarn guide 17, the contact roller 14 and the cantilever arm portion 22 with the two yarn guides 23 and 24 and the winding spindle with the respective empty tube 8 are arranged on one side of the yarn 1, as can be seen from FIGS. 2 and 3, so that the yarn, by virtue of the pivotal movement of the second yarn guide 24 into the gap, can move the yarn 1 away from those elements or can keep it away therefrom, in order thereby to terminate yarn contact or to stop it from occurring. That is particularly important in regard to the surface of the empty tube 8 so that the yarn does not come into frictional contact with the surface of the empty tube 8 and is not damaged in that respect, during the bobbin change operation. The movement for applying the yarn relative to the catch region 11 is also important. That application movement is subdivided into two movements which are approximately at a right angle to each other, wherein in a first step in the movement the yarn reaches a readiness position in front of and at a spacing relative to the catch region 11 while the second part of the movement provides for the contact of the yarn with the catch region 11.

If it seems desirable for the phase involving the yarn 1 coming free from the surface of the contact roller 14 and the phase involving the yarn 1 being kept free from the surface of the empty tube 8, to be separated in respect of time from the yarn coming free from the traversing device 16, it is possible to provide a yarn holder 26 which can be mounted pivotably about the axis 27 and which is shown in FIGS. 1 to 5. FIG. 2 shows the yarn holder in the rest position in which it does not involve any contact with the yarn 1. FIG. 3 shows the yarn holder 26 in the securing position in which, in spite of the pivotal movement of the second yarn guide 24 into the gap, the yarn holder 26 prevents the yarn from coming free from the traversing device 16 until it also pivots away at a time which can be freely selected by a suitable control (FIG. 4) so that in the meantime the yarn 1 can still be laid with a limited laying stroke movement on the surface of the full bobbin 10. That then gives a cycle in the operating procedure, as is shown in FIGS. 2 to 5. The mode of operation of such a winding machine can be seen from the foregoing description. FIG. 3 shows the position which is additionally possible, namely with the second yarn guide 24 which is pivoted into the gap 25 and which brings the yarn out of contact with the surface of the contact roller 14 and holds it out of contact with the surface of the empty tube 8, while the yarn is nonetheless being guided by the traversing device 16 for a limited period of time until the position shown in FIG. 4 is reached.

While the foregoing specification and accompanying drawings disclose a preferred embodiment of the invention, it will be understood by those skilled in the art that variations and modifications can be made thereto without departing from the spirit and scope of the invention, as set forth in the following claims.

LIST OF REFERENCES

1 yarn
2 revolver member
3 axis of rotation
4 winding spindle
5 winding spindle
6 axis
7 axis
8 tube
9 tube
10 bobbin
11 catch region
12 winding spindle direction
13 machine frame
14 contact roller
15 axis of rotation
16 traversing device
17 traversing yarn guide
18 central plane
19 head yarn guide
20 pivotal arm
21 axis
22 cantilever arm portion
23 first yarn guide
24 second yarn guide
25 gap
26 yarn holder
27 axis
28 arrow
29 arrow
30 arrow
31 guide edge
32 projection
33 repulsion surface
34 notch
35 hook

What is claimed is:

1. A winding machine for winding on a continuously fed yarn to form bobbins alternately on a respective tube including a yarn catch region, comprising:

a stationary head yarn guide;

a revolver member;

a first driven winding spindle being mounted on said revolver member for carrying the respective tube;

a second driven winding spindle being mounted on said revolver member for carrying the respective tube;

a traversing device;

a contact roller;

a pivotal arm being designed and arranged to be pivotable about a stationary axis into a gap between one of the bobbins and an empty tube being located on one of said winding spindles;

a first yarn guide being movable in the direction of said winding spindles and being designed and arranged to position the yarn relative to the yarn catch region of an empty tube being located on one of said winding spindles, said first yarn guide being arranged on said pivotal arm;

a second yarn guide for the end of the yarn running onto a full bobbin on the other one of said winding spindles, said second yarn guide being arranged on said pivotal arm;

said first and second yarn guide being designed and arranged such that in operation said first and second yarn guide, said traversing device, said contact roller and said winding spindle carrying the empty tube are located on the same side of the yarn in such a mutual relative position that after a pivotal movement of said pivotal arm carrying said first and second yarn guide into the gap the yarn does not contact the empty tube and said traversing device; and said first and second yarn guide being designed and arranged such that during a return pivotal movement of said pivotal arm under the effect of said head yarn guide and said first yarn guide the yarn still contacts the first yarn guide and the yarn gets in contact with the yarn catch region of the empty tube with an increase in the wrapping angle therearound.

2. The winding machine of claim 1, wherein said second yarn guide includes a straight guide edge extending in the direction of said winding spindles and a projection adjoining said straight guide edge and extending in the direction of inward pivotal movement of said pivotal arm into the gap.

3. The winding machine of claim 1, wherein said first yarn guide is mounted on said pivotal arm movably in the direction of said winding spindles in the region of said second yarn guide, and it includes a hook which is curved in the direction of the return pivotal movement.

4. The winding machine of claim 1, wherein said winding spindles are driven to rotate in an opposite direction than the direction of travel of the yarn.

5. The winding machine of claim 1, wherein said head yarn guide, said traversing device and said contact roller are arranged in substantially vertically oriented relationship above the axis of rotation of said revolver member.

6. The winding machine of claim 1, wherein said first yarn guide is arranged on said pivotal arm displaceably between a parking position on the side remote from the catch region of an empty tube on the respective winding spindle outside the traversing stroke movement and a readiness position on the side towards the catch region of the tube outside the traversing stroke movement.

7. A winding machine for winding on a continuously fed yarn to form bobbins alternately on a respective tube including a yarn catch region, comprising:

a stationary head yarn guide;

a revolver member;

a first driven winding spindle being mounted on said revolver member for carrying the respective tube;

a second driven winding spindle being mounted on said revolver member for carrying the respective tube;

a traversing device;

a contact roller;

a pivotal arm being designed and arranged to be pivotable about a stationary axis into a gap between one of the bobbins and an empty tube being located on one of said winding spindles;

a first yarn guide being movable in the direction of said winding spindles and being designed and arranged to position the yarn relative to the yarn catch region of an empty tube being located on one of said winding spindles, said first yarn guide being arranged on said pivotal arm;

a second yarn guide for the end of the yarn running onto a full bobbin on the other one of said winding spindles, said second yarn guide being arranged on said pivotal arm;

said first and second yarn guide being designed and arranged such that in operation said first and second yarn guide, said traversing device, said contact roller and said winding spindle carrying the empty tube are located on the same side of the yarn in such a mutual relative position that after a pivotal movement of said pivotal arm carrying said first and second yarn guide into the gap the yarn does not contact the empty tube and said traversing device;

said first and second yarn guide being designed and arranged such that during a return pivotal movement of said pivotal arm under the effect of said head yarn guide and said first yarn guide the yarn still contacts the first yarn guide and the yarn gets in contact with the yarn catch region of the empty tube with an increase in the wrapping angle therearound; and a yarn holder being movably mounted in the region of said traversing device on the other side of the yarn between a holding position to secure the yarn guided by said traversing device and a parking position to release the yarn.

8. A method of winding on a continuously fed yarn to form bobbins alternately onto respective tubes, each tube including a yarn catch region, said method comprising the steps of:

laying the yarn on a first bobbin on a first tube by way of a stationary head yarn guide, a traversing device and a contact roller;

rotating a revolver member including first and second driven winding spindles being rotatably mounted thereon into a change position;

rotating a pivotal arm being pivotable about a stationary axis into the gap between the bobbin on the first tube on the first winding spindle and the empty tube on the second winding spindle, the pivotal arm including a first yarn guide being movable in the direction of the winding spindles relative to the yarn catch region of the empty tube and a second yarn guide;

contacting the yarn with the first and second yarn guide, the yarn being laid on the first bobbin on the first tube by the second yarn guide;

releasing the yarn from contact with the traversing device, with the contact roller and with the empty tube;

moving the yarn from the change position into a readiness position in front of the catch region of the empty second tube in the direction of the winding spindles with the first yarn guide; and rotating the pivotal arm back in a direction away from the gap such that the yarn gets in contact with the yarn catch region of the empty tube, with the traversing device and with the contact roller as the first yarn guide continues to contact and guide the yarn, the yarn being divided in the region of the gap.

9. The method of claim 8, wherein in the step of moving the yarn from the change position into a readiness position in front of the catch region of the empty second tube in the direction of the winding spindles with the first yarn guide the yarn is guided in a laying triangle being formed by the head yarn guide and the first yarn guide.

10. The method of claim 8, wherein the yarn is caught in opposite motional relationship in the catch region of the empty tube.

* * * * *